US006308443B1

(12) United States Patent
Lin

(10) Patent No.: US 6,308,443 B1
(45) Date of Patent: Oct. 30, 2001

(54) REPLACEABLE AND EASILY ASSEMBLING WATER-BALL DECORATION

(76) Inventor: Hsi-Chun Lin, P.O. Box 96-405, Taipei 106 (TW)

( * ) Notice: Subject to any disclaimer, the term of this patent is extended or adjusted under 35 U.S.C. 154(b) by 0 days.

(21) Appl. No.: 09/376,358

(22) Filed: Aug. 18, 1999

(51) Int. Cl.[7] ..... G09F 19/00
(52) U.S. Cl. ..... 40/406; 446/267; 40/409
(58) Field of Search ..... 40/406, 407, 408, 40/409, 410; 446/267

(56) References Cited

U.S. PATENT DOCUMENTS 5,456,031 * 10/1995 Hou ..... 40/410
5,675,921 * 10/1997 Lin ..... 40/409
5,732,492 * 3/1998 Lin ..... 40/410
5,875,577 * 3/1999 Lu ..... 40/410 X
5,971,831 * 10/1999 Hsu ..... 446/267
5,989,655 * 11/1999 Meng ..... 40/406 X

* cited by examiner

*Primary Examiner*—Brian K. Green
*Assistant Examiner*—James M Hewitt
(74) *Attorney, Agent, or Firm*—Dougherty & Troxell

(57) ABSTRACT

A replaceable and easily assembled water-ball decoration, of which the base part of the major ornamental part is furnished with at least a through cylindrical hole for receiving a water-ball ornament; the neck part of the glass ball is covered with the fastening base; the lower ring surface of the cylindrical hole in the base part of the major ornamental part is mounted with a fastening disk; by means of a screw, the water-ball ornament is fastened in the base part of the major ornamental part; the water-ball ornament can easily be assembled and replaced with a different ornament on the major ornamental part.

3 Claims, 7 Drawing Sheets

REPLACEABLE AND EASILY ASSEMBLING WATER-BALL DECORATION

BACKGROUND OF THE INVENTION

1. Field of the Invention

This invention relates to a water ball, and particularly to a replaceable and easily assembled water-ball decoration.

2. Description of the Prior Art

In conventional water-ball ornaments, the inner side of the neck part of the glass ball is closed and sealed with a leak-proof rubber plug, of which the inner center is glued with an ornament; the glass ball is filled with water before being mounted on a base part. The ornament in the glass ball is enlarged by means of the convex lens effect of the glass ball.

According to the aforesaid conventional ornament, the neck part of the glass ball and the base part are connected together by following the steps of mounting the neck part of the glass ball on the upper part of a cylindrical hole of the base part, and then filling a sealing plastic into the cylindrical hole by means of a plastic-filling gun so as to have the cylindrical hole and the neck part of the glass ball fastened together in the gap between them. The glass ball and the base part are connected together as one piece without being separated from each other again; in other words, the glass balls on two different ornamental base parts can not be exchanged.

SUMMARY OF THE INVENTION

The prime object of the present invention is to provide a water-ball decoration, in which the base part of the major ornamental part is furnished with at least a through cylindrical hole; the upper ring surface of the cylindrical hole is used for supporting and positioning the fastening base of the water-ball ornament; the lower ring surface of the cylindrical hole is used for receiving a fastening disk to be fastened in place with a screw, which is engaged with a nut under the bottom of the fastening base so as to facilitate the placement of different water-ball ornaments on the base part.

Another object of the present invention is to provide a water-ball decoration, in which the base part of the major ornamental part has a cylindrical hole with an upper ring surface to facilitate the positioning ring of the fastening base of the water-ball ornament so as to enable the water-ball ornament and the cylindrical hole of the major ornamental part to be properly positioned and connected together.

Still another object of the present invention is to provide a water-ball decoration, in which the fastening base is connected to the outer edge of the neck part of the glass ball in the water-ball ornament, and the fastening base covers the neck part of the glass ball and the leak-proof rubber plug so as to provide protection for the bottom of the water-ball ornament.

A further object of the present invention is to provide a water-ball decoration, in which the inside of the fastening base under the bottom of the water-ball ornament has a ring-shaped groove which includes an inner ring surface and an outer ring surface. There are quite short distance among the inner and outer ring surfaces and the bottom of the neck part of the glass ball and the inner surface of the leak-proof rubber plug. After a suitable amount of a sealing plastic is injected into the ring-shaped groove, the neck part of the glass ball should be moved to plug into the ring-shaped groove of the fastening base so as to enable the neck part of the glass ball and the fastening base to connect together as one piece.

Still a further object of the present invention is to provide a water-ball decoration, in which the diameter of the glass ball of the water-ball ornament may be different; the neck part of the glass ball is used for fitting the leak-proof rubber plug to seal in place, and the height thereof would not change much. The water-ball ornament can directly be placed on a table by means of a fastening base having a short outer cylinder.

Yet another object of the present invention is to provide a water-ball decoration, in which the center of the fastening base of the water-ball ornament has a nut for receiving a screw passing through a round hole of a fastening disk so as to have the water-ball ornament fixed on the base part of the major ornamental part.

DETAILED DESCRIPTION OF THE PREFERRED EMBODIMENTS

Figure 1:
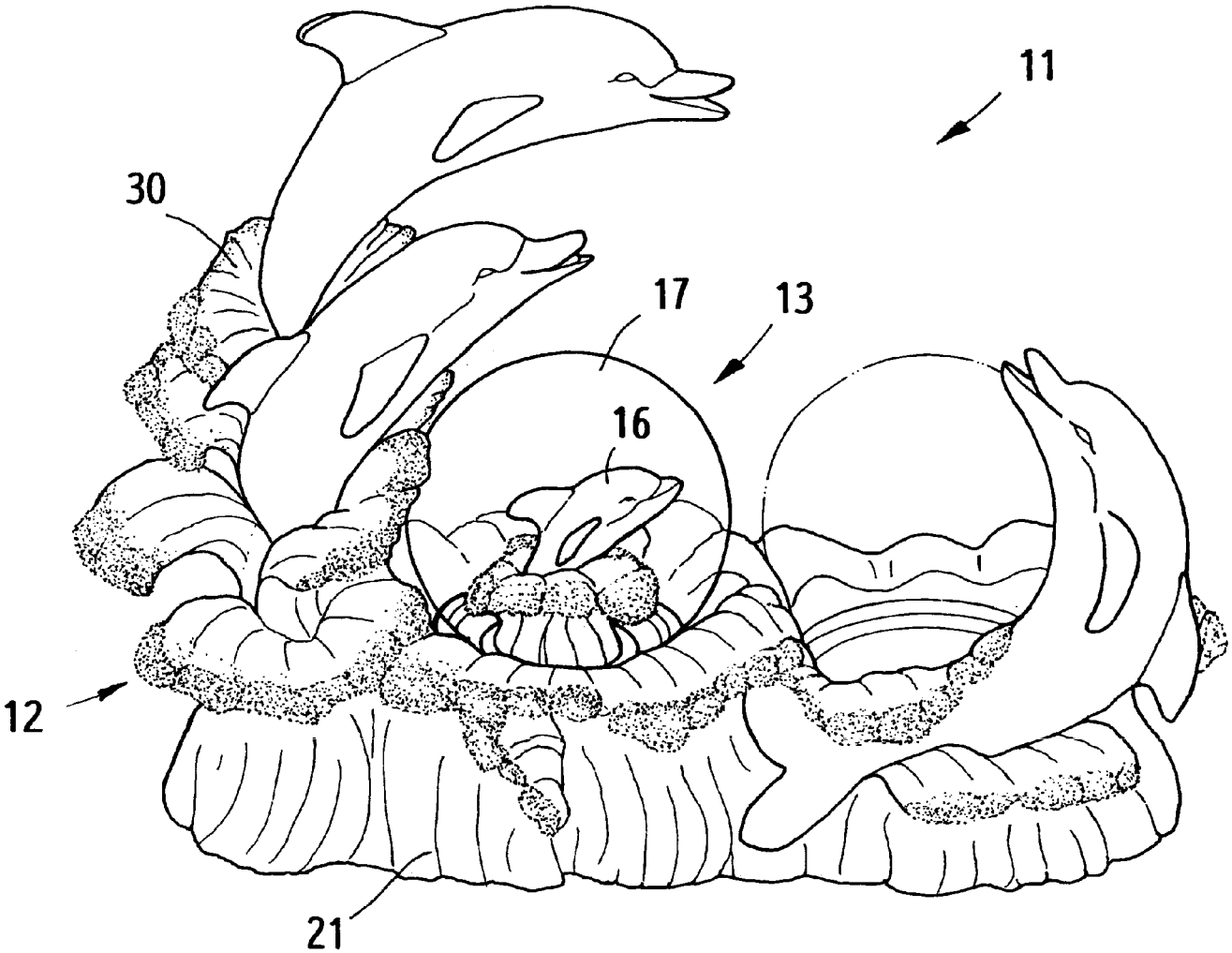
FIG. 1 is a perspective view of the present invention, showing the outer view of the water-ball decoration.
Figure 2:
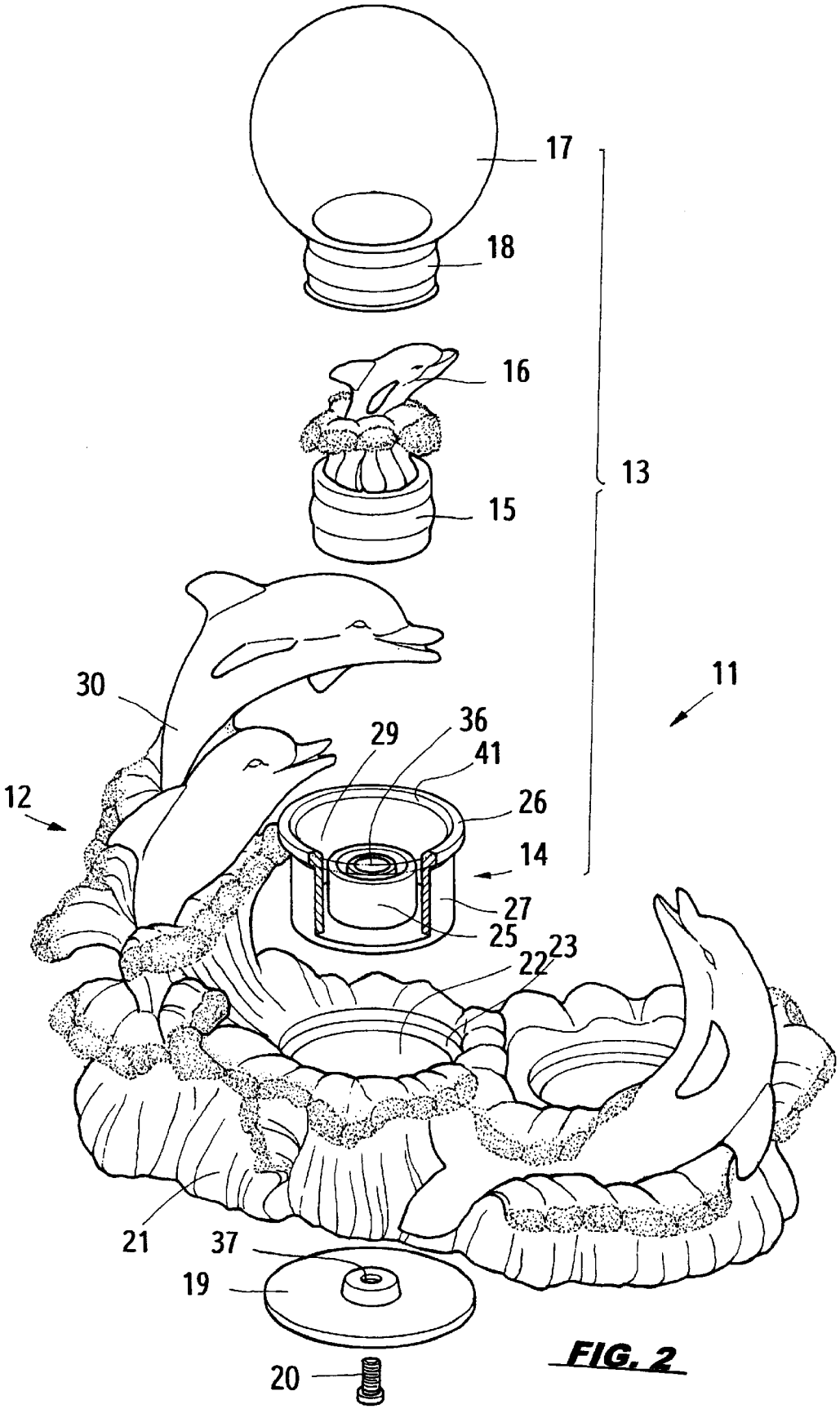
FIG. 2 is a disassembled view of the present invention, showing the structural relation between the major ornamental part and the water-ball ornament.
Figure 3:
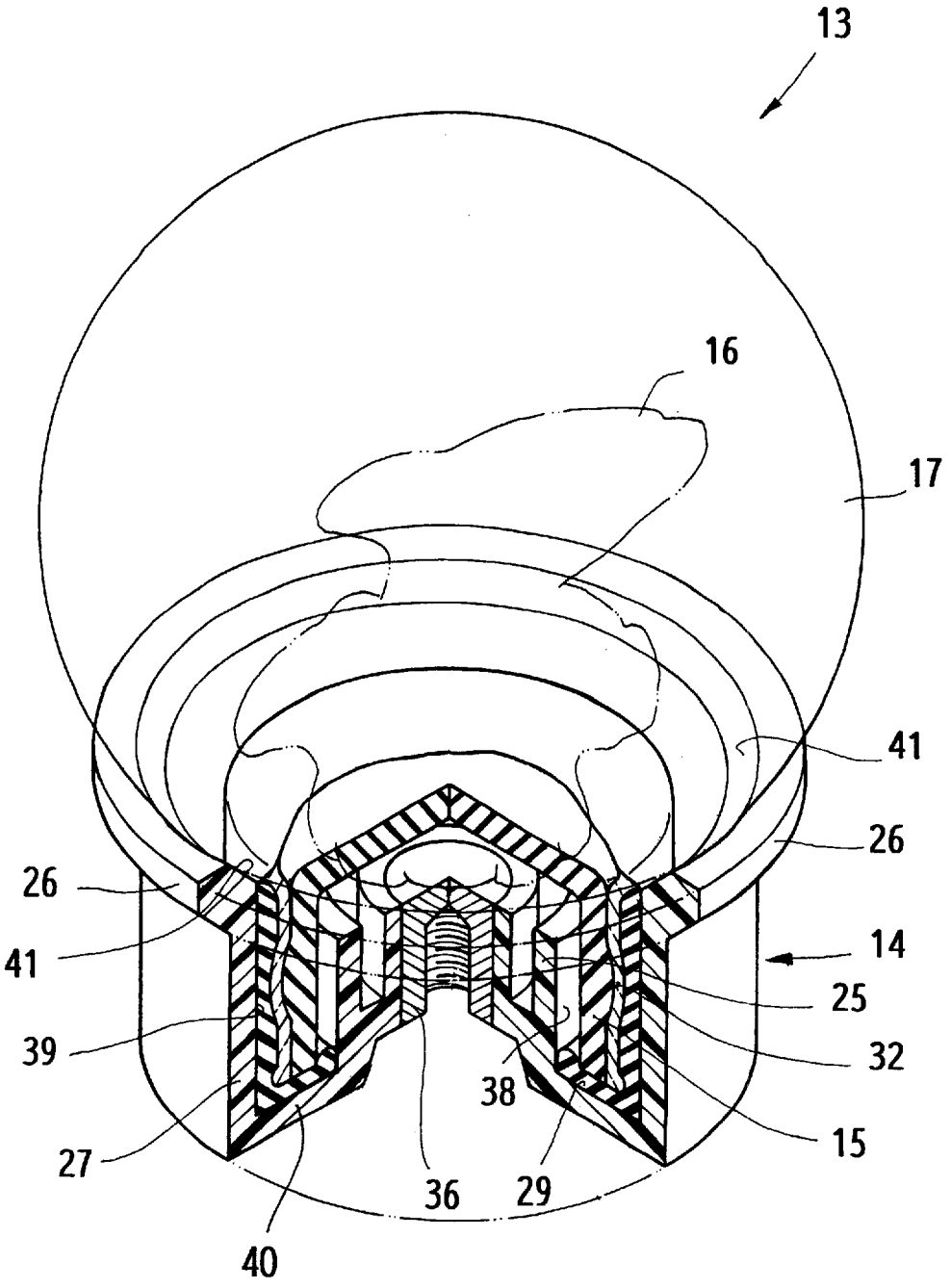
FIG. 3 is a fragmental section view of the present invention, showing the assembled relation among the water-ball ornament.
Figure 4:
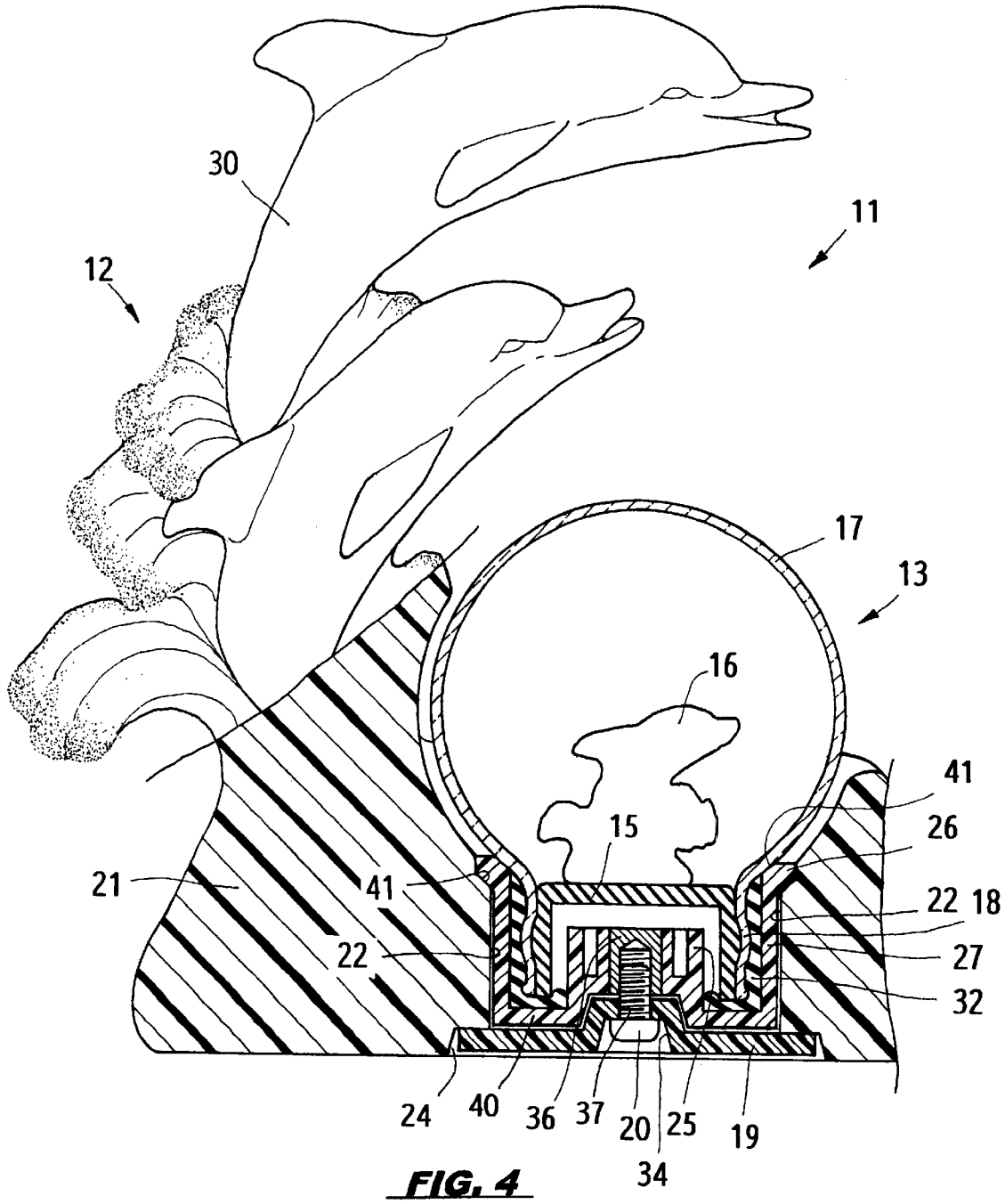
FIG. 4 is a sectional view of the present invention, showing the assembled relation between the major ornamental part and the water-ball ornament.

Referring to FIGS. 1 to 3, the water-ball decoration 11 according to the present invention comprises a major ornamental part 12, a water-ball ornament 13, a fastening disk 19 and a screw 20. The base part 21 of the major ornamental part 12 has at least a through cylindrical hole 22. The water-ball ornament 13 is mounted in place by sitting on the upper ring surface 23 of the cylindrical hole 22. The lower ring surface 24 of the cylindrical hole 22 is mounted with the fastening disk 19 by using a screw 20 through a round hole 37 of the fastening disk 19 so as to fasten the water-ball ornament 13 in the cylindrical hole 22 of the base part 21 of the major ornamental part 12; by means of the aforesaid parts, the water-ball ornament 13 can easily be mounted on the base part 21 of the major ornamental part 12 or replaced with a different ornament.

The center of the base part 21 of the major ornamental part 12 is furnished with at least a through cylindrical hole 22. The outer edge of the base part 21 is mounted with a topic ornament 30, which as showing in FIG. 1 includes dolphins.

The cylindrical hole 22 of the base part 21 of the main ornamental part 12 is slightly larger than the diameter of the outer cylinder 27 of the fastening base 14 of the water-ball ornament 13 so as to enable the fastening base 14 of the water-ball ornament 13 to fit in the cylindrical hole 22. The upper part of the cylindrical hole 22 has an upper ring surface 23 with a bevel face; the lower end of the cylindrical hole 22 has an indented lower ring surface 24. After the water-ball ornament 13 is mounted on the upper ring surface 23, the outer cylinder 27 of the fastening base 14 of the water-ball ornament 13 will be fitted in the cylindrical hole 22; then, the upper ring surface 23 will be in contact with the positioning ring 26 of the outer cylinder 27 so as to have the water-ball ornament 13 positioned in place directly. The fastening disk 19 under the lower ring surface 24 of the cylindrical hole 22 is substantially a round disk, of which the center has a sunk-screw hole 34 and a through round hole 37 for receiving a screw 20; the head of the screw 20 is sunk into the sunk-screw hole 34. The screw will fit into a nut 36 in the center of the fastening base 14, and then the water-ball ornament 13 will be fixedly mounted in the cylindrical hole 22 of the base of the base part 21 of the major ornamental part 12.

The water-ball ornament 13 includes a fastening base 14, a leak-proof rubber plug 15, an ornament 16 and a glass ball 17. The connection between the neck part 18 of the glass ball 17 and the leak-proof rubber plug 15 is done by means of a conventional skill; the ornament 16 of the water-ball ornament 13 is so designed as to fit the topic ornament 30 of the major ornamental part 12. The bottom of the ornament 16 is connected with the top surface of the leak-proof rubber plug 15. The bottom of the glass ball 17 has an opening with a neck part 18. After the glass ball 17 is filled with water, the ornament 16 glued on the top surface of the leak-proof rubber plug 15 can be fitted into the glass ball 17 through the neck part 18 so as to have the leak-proof rubber plug 15 and the neck part 18 assembled and connected together. The ornament 16 in the glass ball 17 will have an enlarged effect as a result of the convex lens effect of the glass ball 17. After the glass ball 17 and the leak-proof rubber plug 15 are assembled together, the neck part 18 of the glass ball 17 and the fastening base 14 are also assembled together as one piece so as to form into an independent water-ball ornament 13.

The fastening base 14 of the water-ball ornament 13 is connected around the leak-proof rubber plug 15 and the neck part 18 of the glass ball 17. The fastening base 14 includes a bottom disk 40, a nut 36, an inner cylinder 25 and an outer cylinder 27, which are molded into an integrated piece. The outer cylinder 27 is higher than the inner cylinder 25. The positioning ring 26 mounted around the neck part 18 of the glass ball 17 has a larger diameter; the inner surface 41 of the positioning ring 26 is to be in contact with the glass ball 17. Among the inner cylinder 25, the bottom disk 40 and the outer cylinder 27 of the fastening base 14, there is a hollow space to form into a ring-shaped groove 29 for receiving the leak-proof rubber plug 15 and the neck part 18 of the glass ball 17. The outer ring surface 38 and the inner ring surface 39 of the ring-shaped groove 29 maintain a very short distance from the neck part 18 and the inner surface of the leak-proof rubber plug 15; the height of the ring-shaped groove 29 is slightly higher than that of the neck part 18 of the glass ball 17. The space in the ring-shaped groove 29 is to be filled with a suitable amount of sealing plastics 32 on the inner ring surface 39 of the outer cylinder 27 before the glass ball 17 being fitted in the ring-shaped groove 29; after the glass ball 17 is mounted in place, push the sealing plastics 32 slowly until the sealing plastics completely covering the space between the neck part 18 and the inner ring surface 39 of the outer cylinder 27, and space between the leak-proof rubber plug 15 and the outer ring surface 38 of the inner cylinder 25. The center of the bottom disk 40 of the fastening base 14 is furnished with a nut 36 for receiving a screw 20 after the water-ball ornament 13 being fastened in place.

To assemble the water-ball ornament 13 and the major ornament part 12 together, the fastening base 14 of the water-ball ornament 13 should face the cylindrical hole 22 of the base part 21 of the major ornamental part 12. The outer cylinder 27 of the fastening base 14 is slightly smaller than the cylindrical hole 22 of the base part 21 so as to facilitate the assembling thereof. The upper ring surface 23 of the cylindrical hole 22 can facilitate the proper positioning of ring 26 of the fastening base. The lower ring surface 24 of the cylindrical hole 22 is mounted with a fastening disk; a sunk-screw hole 34 of the disk faces down to enable the screw 20 to pass through a round hole 37 and to engage with a nut 36 of the fastening base 14 of the water-ball ornament 13; then, the water-ball ornament 13 can easily be fastened in the cylindrical hole 22 of the base part 21.

The water-ball decoration 11 for a different topic ornament 30 will have different diameter and size; also, the size of the fastening base 14 for mounting the neck part 18 of the glass ball 17 will be changed. The ring-shaped groove 29 between the inner cylinder 25 and the outer cylinder 27 is used for receiving the neck part 18 and the leak-proof rubber plug 15, and for the connection thereof.

Figure 5:
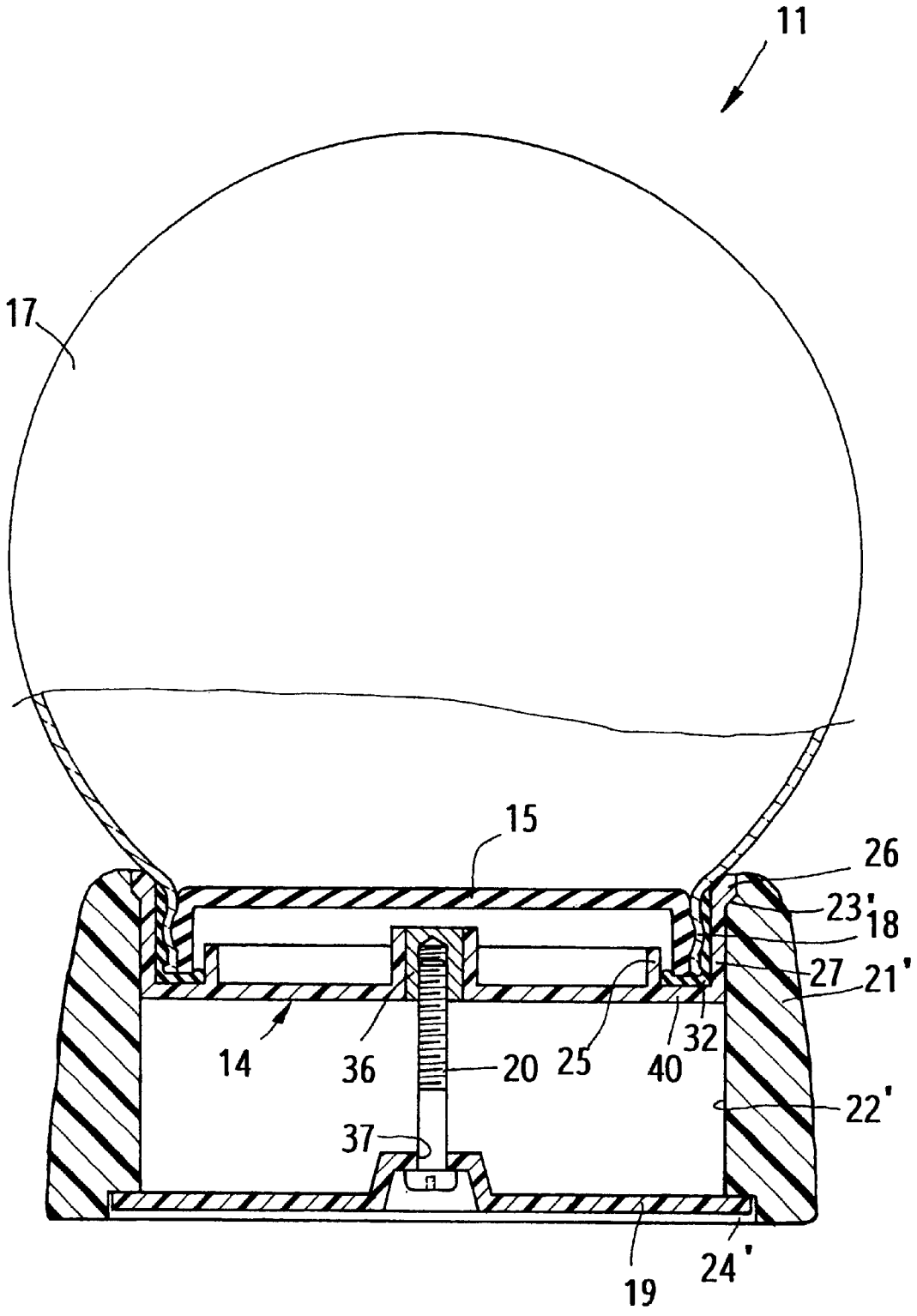
FIG. 5 is a sectional view of the present invention, showing an embodiment of the parts of a large water ball assembled together with a base part.
Figure 6:
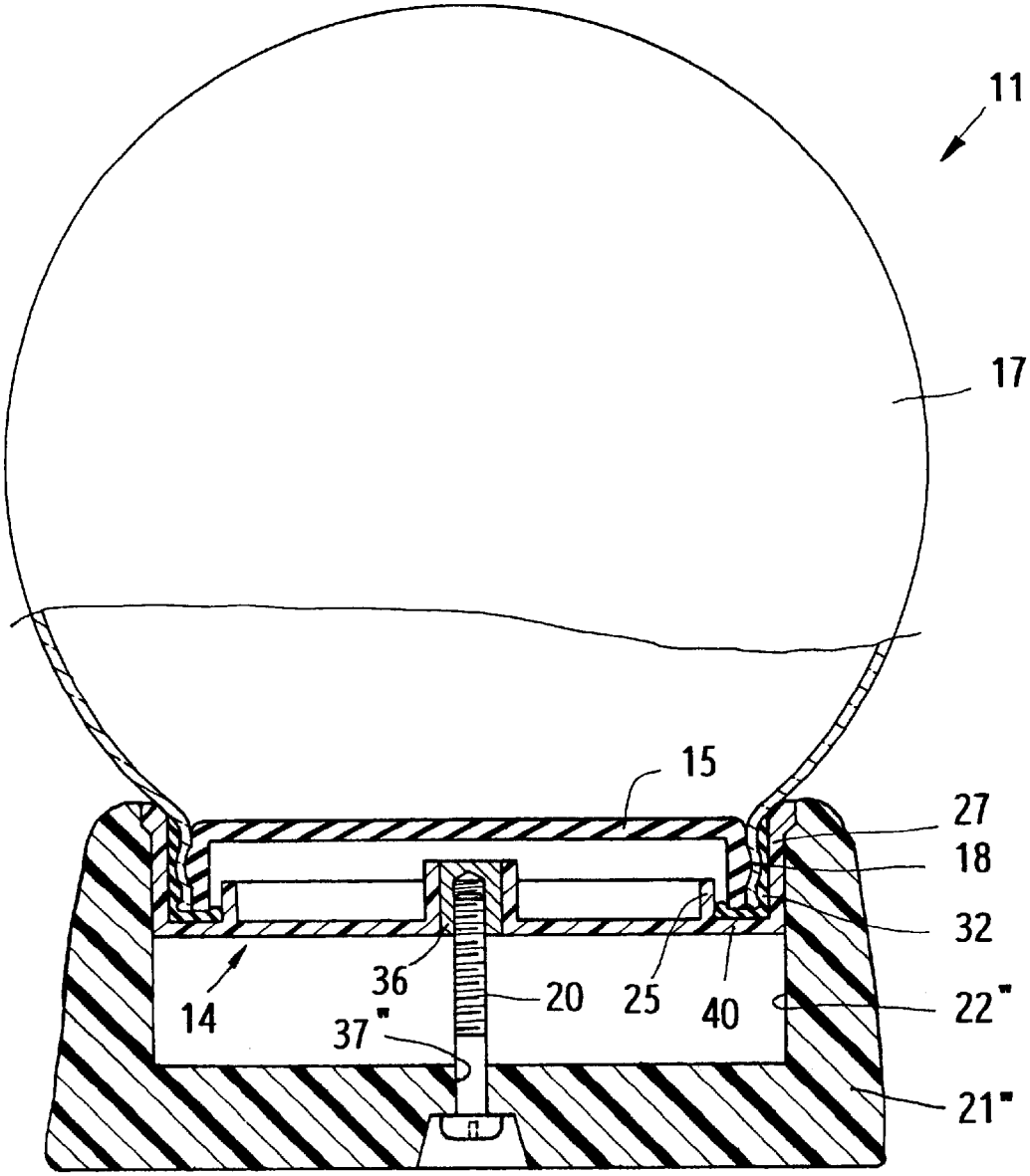
FIG. 6 is a sectional view of the present invention, showing a second assembling embodiment between the water-ball part and the base part.

As shown in FIGS. 5 and 6, the top ornament 30 of the water-ball decoration 11 is mounted on a round base part 21'. The diameter of the glass ball 17 and the height of the neck part 18 are quite different from that of the aforesaid embodiment; in other words, the glass ball 17 has a larger diameter, and the diameter of the neck part 18 will be increased, too; the height of the neck part 18 is not changed. After the diameter of the neck part 18 is increased, the diameter of the outer and inner ring surfaces 38 and 39 of the ring-shaped groove 29 in the fastening base 14 will also be increased, but the distances between the outer ring surface 38, the leak-proof rubber plug 15, and between the inner ring surface 39 and the neck part 18 are not changed. To assemble the aforesaid parts, a sealing plastics 32 is filled into the ring-shaped groove 29 so as to have the neck part 18 of the glass ball 17 and the ring-shaped groove 29 of the fastening base 14 connected together as one piece.

After the glass ball 17 is mounted on the ring-shaped base part 21, the outer cylinder 27 of the fastening base 14 can easily be fitted into the cylindrical hole 22'; then, the positioning ring 26 of the fastening base 14 will be mounted and positioned on the upper ring surface 23' of the cylindrical hole 22. As shown in FIG. 5, the lower ring surface 24' of the cylindrical hole 22' of the base part 21 is mounted with a fastening disk 19, which is fixed in place with a screw 20 to pass through a round hole 37 of the fastening disk 19 and to engage with a nut 36 of the fastening base 14 so as to have the water-ball ornament 13 fastened to the base part 21'. As shown in FIG. 6, the cylindrical hole 22" of the base part 21" is a recessed hole; the center of the hole 22" has a through round hole 37" for receiving the screw 20, which is then engaged with the nut 36 of the fastening base 14 so as to fix the water-ball ornament 13 on the base part 21". The water-ball ornament 13 and the base part 21" can easily be disassembled by removing the screw 20 so as to facilitate replacing the topic ornament 30 and the water-ball ornament 13 without changing the fastening base 14; in other words, the water-ball ornament 13 or the topic ornament 30 can be changed and replaced.

Figure 7:
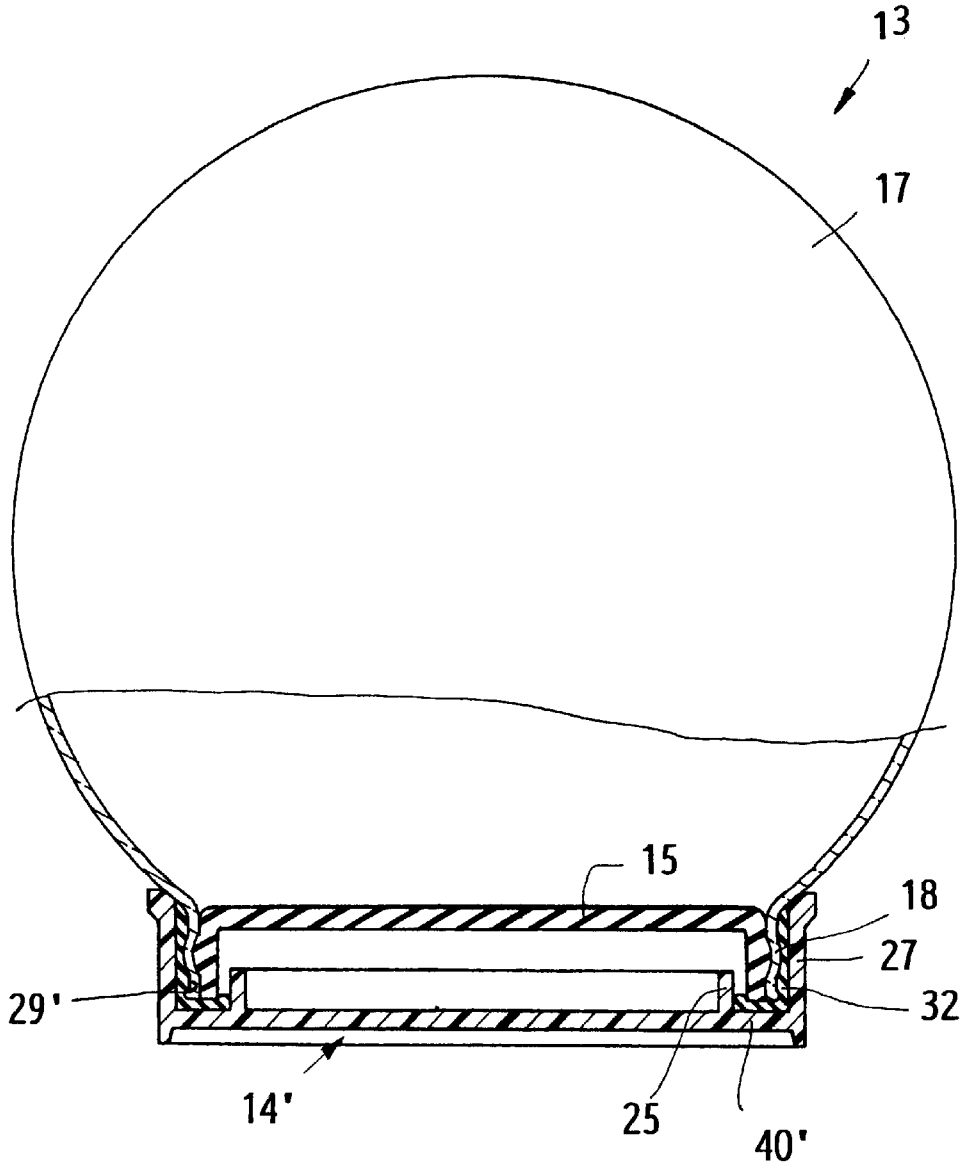
FIG. 7 is a sectional view of the present invention, showing the fastening base of the water-ball ornament being mounted on the major ornamental part directly.

Referring to FIG. 7, the bottom disk 40' of the center of the fastening base 14' of the water-ball ornament 13 has no nut; the water-ball ornament 13 is to be placed on the top surface of a table, or mounted on a base part 21 having a cylindrical hole 22.

In the water-ball decoration, the fastening base 14' has a ring-shaped groove 29', in which the neck part 18 of the glass ball 17 can be mounted in place by using the bottom of a leak-proof rubber plug 15 to cover and connect together as one piece. The fastening base 14' can easily be mounted in the cylindrical hole of a base part of a topic ornament, and then the base part and the fastening base 14' can be assembled together by means of a screw; however, it can be assembled or disassembled easily for replacement.

What is claimed is:

1. A replaceable and easily assembled water-ball decoration comprising:

a) a major ornamental part, having a base part mounted with a topic ornament, said base part having at least one cylindrical hole with an upper ring surface; and, b) a water-ball ornament mounted in said cylindrical hole in the base part and including:

a glass ball having a neck part, said glass ball filled with water;

an ornament attached to a leak-proof rubber plug, said leak-proof rubber plug sealingly mounted in said neck part, such that said ornament is within said glass ball;

a fastening base including a bottom disk, a nut, an inner cylinder and an outer cylinder receiving said leak-proof rubber plug and said neck part of said glass ball, said outer cylinder mounted around said neck part of said glass ball, an upper part of said fastening base having an outwardly extending positioning ring with an inner surface in contact with said glass ball, said inner cylinder extending upwardly from said bottom disk, said inner cylinder, said bottom disk and said outer cylinder bounding a ring-shaped groove with sealing plastic therein so as to seal said neck part, an inner surface of said leak-proof rubber plug and said fastening base connected together, a center of said bottom disk of said fastening base furnished with said nut facing downwards; and a fastening disk having a center thereof furnished with a sunk-screw hole and a through hole; said fastening disk mounted under said cylindrical hole of said base part and a screw extending through the center hole and engaging the nut in the center of said bottom disk of said fastening base.

2. The replaceable and easily assembled water-ball decoration as claimed in claim 1 wherein the outwardly extending positioning ring engages the upper ring surface of the base part.

3. The replaceable and easily assembled water-ball decoration as claimed in claim 1 further comprising a lower ring surface on the base part adjacent to said at least one cylindrical hole, wherein said fastening disk engages the lower ring surface.

* * * * *